US011147139B2

(12) United States Patent
Wang et al.

(10) Patent No.: US 11,147,139 B2
(45) Date of Patent: Oct. 12, 2021

(54) DEVICE FOR DRIVING LED AND METHOD FOR DRIVING LED

(71) Applicant: Delta Electronics (Shanghai) CO., LTD, Shanghai (CN)

(72) Inventors: Xiaobo Wang, Shanghai (CN); Xiaoping Fu, Shanghai (CN); Xinghua Zhang, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 26 days.

(21) Appl. No.: 16/708,683

(22) Filed: Dec. 10, 2019

(65) Prior Publication Data

US 2020/0205265 A1 Jun. 25, 2020

(30) Foreign Application Priority Data

Dec. 19, 2018 (CN) ..... 201811557902.X

(51) Int. Cl.
*H05B 45/37* (2020.01)
*H05B 45/3725* (2020.01)

(52) U.S. Cl.
CPC ..... *H05B 45/3725* (2020.01)

(58) Field of Classification Search
CPC ..... H05B 45/3725; H05B 45/36
See application file for complete search history.

(56) References Cited

U.S. PATENT DOCUMENTS 4,665,323 A * 5/1987 Russell ..... H02M 1/10 307/75
5,608,614 A 3/1997 Ohnishi et al.
7,602,593 B2 10/2009 Asano
2017/0005652 A1* 1/2017 Hatano ..... H03K 17/691
(Continued)

FOREIGN PATENT DOCUMENTS

CN 104682712 A 6/2015
CN 104734486 A 6/2015
CN 204597808 U 8/2015
(Continued)

OTHER PUBLICATIONS

The JP1OA issued Dec. 8, 2020 by the JPO.
The 1st Office Action dated Jul. 28, 2021 for CN patent application No. 201811557902.x.

*Primary Examiner* — Amy Cohen Johnson
*Assistant Examiner* — Jianzi Chen
(74) *Attorney, Agent, or Firm* — Qinghong Xu

(57) ABSTRACT

The present disclosure discloses a device and a method for driving an LED. The device includes: a rectifier circuit for receiving an AC voltage and convert the AC voltage into a first DC voltage; a capacitance-adjusting circuit including a first capacitor, a second capacitor and a switch; and a DC-DC converter for converting the first DC voltage into a second DC voltage, wherein a range of a voltage value of the AC voltage comprises a first AC voltage range and a second AC voltage range, and when the voltage value of the AC voltage is in the first AC voltage range, the capacitance-adjusting circuit has a first capacitance value; and when the
(Continued)

voltage value of the AC voltage is in the second AC voltage range, the capacitance-adjusting circuit has a second capacitance value, and the first capacitance value is greater than the second capacitance value.

11 Claims, 12 Drawing Sheets

(56) References Cited

U.S. PATENT DOCUMENTS

| | | | | |
|---|---|---|---|---|
| 2017/0317582 | A1* | 11/2017 | Leong | H02M 1/14 |
| 2018/0191237 | A1 | 7/2018 | Nikitin | |

FOREIGN PATENT DOCUMENTS

| | | | |
|---|---|---|---|
| CN | 107453629 | A | 12/2017 |
| JP | S645362 | A | 1/1989 |
| JP | 2013251951 | A | 12/2013 |
| JP | 2014116279 | A | 6/2014 |
| JP | 2014212654 | A | 11/2014 |

* cited by examiner

DEVICE FOR DRIVING LED AND METHOD FOR DRIVING LED

CROSS-REFERENCE TO RELATED APPLICATIONS

This application is based on and claims priority to Chinese patent application No. 201811557902.X filed on Dec. 19, 2018. The entire content of which is hereby incorporated by reference for all purposes.

TECHNICAL FIELD

The present disclosure generally relates to the field of LED driving technologies, and more particularly, to a device for driving an LED and a method for driving an LED.

BACKGROUND

IEC61000-3-2 is a standard specification for harmonic currents in electromagnetic compatibility (EMC). According to the requirements of new IEC61000-3-2 (2018) specification, a driving power supply with input power below 25 W needs to meet the requirements of CLASS C (level C). According to the definition of the specification, if the driving power supply with the input power below 25 W meets the following two conditions at the same time, it is considered as meeting the requirements of the CLASS C.

Condition A: harmonic numbers of an input current are illustrated in Table 1.

TABLE 1

| Harmonic Number | Harmonic Current/Fundamental Current * 100% |
|---|---|
| 1 | 100% |
| 3 | 86% |
| 5 | 61% |

Condition B: an angle of an input current waveform is like that of a current waveform illustrated in FIG. 1. Referring to FIG. 1, the sine wave is corresponding input voltage waveform.

FIG. 2 is a schematic diagram illustrating a circuit structure applicable to an LED driving power supply device with an input power below 25 W according to an example. The LED driving power supply 1 illustrated in FIG. 2 uses a bridge rectifier 11 and a single-stage DC-DC converter 12 to realize control of a constant output voltage or constant output current.

For the LED driving power supply 1, when an input voltage is within a small input voltage range, if a capacitor C1 adopts a proper capacitance value, the LED driving power supply 1 can satisfy the above two conditions A and B. i.e., it meets the requirements of harmonic IEC61000-3-2, and at the same time, it can control a ripple voltage Vdc to be very low that the LED has no low frequency flicker.

However, when the input voltage varies within a wide range, it is difficult to select a suitable capacitance value for the capacitor C1. Taking an LED driving power supply of 10 W as an example, FIG. 3 is a schematic diagram illustrating relationships between the input voltage and an input capacitance of the LED driving power supply of 10 W. In FIG. 3, the upper oblique line denotes capacitance values of maximum capacitances that meet the harmonic requirements while the lower oblique line denotes capacitance values of minimum capacitances that can realize a low ripple. As illustrated in FIG. 3, when an input voltage Vac is between 100V and 120V, the capacitance value of the capacitor C1 is generally selected to be greater than 10 uF (microfarad) and less than 15 uF, thereby the requirements of the CLASS C can be met and no flicker will be output; and when the input voltage Vac is between 220V and 240V, the capacitance value of the capacitor C1 is generally selected to be greater than 4 uF and less than 7 uF, thereby the requirements of CLASS C can be met and no flicker will be output.

However, if an inappropriate capacitance value is selected for meeting a wider input voltage range, the requirements of the CLASS C will not be met, or even if they are met, quality of the light will be affected due to the flicker caused by high output ripple. Taking an input voltage of 100V as an example, when a larger capacitance value of the capacitor C1 is selected, referring to FIG. 1 and FIG. 4, Vdc ripple is low. However, because ON time of the bridge rectifier 11 is shorter, a starting current angle of a current Iac is larger and thus cannot meet the requirement that the angle should be less than 60 degrees as shown in FIG. 1. When a smaller capacitance value of the capacitor C1 is selected, referring to FIG. 1 and FIG. 5, the ON time of the bridge rectifier 11 is longer, the starting angle of the current Iac is smaller, which meets the requirement that the angle should be less than 60 degrees and thus meets the requirements of the CLASS C, however, because the Vdc ripple is higher, the DC-DC converter 12 might transfer the Vdc ripple to the output terminal, which then leads to a low frequency ripple in the output LED current, thus affecting the light quality.

Therefore, for the LED driving power supply 1 that requires an input voltage in a wide range, the capacitor C1 cannot be selected easily to meet the requirements of the CLASS C when the input voltage varies greatly.

The foregoing information disclosed in Background are only for better understanding of the background of the present disclosure and therefore it can include information that does not constitute the existing technology already known to those of ordinary skill in the art.

SUMMARY

The present disclosure provides a device for driving an LED and a method for driving an LED, which can adjust a capacitance value according to a magnitude of an input voltage, such that an LED driving power supply can meet the requirements of the CLASS C more easily, regardless of the range of the input voltage.

Other features and advantages of the present disclosure will become obvious from the following detailed description, or may be learned in part from practice of the present disclosure.

According to an aspect of the present disclosure, there is provided a device for driving an LED, including: a rectifier circuit, having an input terminal and an output terminal, and configured to receive an AC voltage at the input terminal and convert the AC voltage into a first DC voltage at the output terminal; a capacitance-adjusting circuit, electrically connected to the output terminal of the rectifier circuit, and including a first capacitor, a second capacitor and a switch, wherein the first capacitor is electrically connected to the second capacitor and the switch is electrically connected to the second capacitor; and a DC-DC converter, electrically connected to the capacitance-adjusting circuit, and configured to convert the first DC voltage into a second DC voltage to drive an LED load, wherein a range of the AC voltage includes a first AC voltage range and a second AC voltage range, and a voltage value in the first AC voltage range is lower than a voltage value in the second AC voltage range, and when the voltage value of the AC voltage is in the first AC voltage range, the switch is controlled such that the capacitance-adjusting circuit has a first capacitance value; and when the voltage value of the AC voltage is in the second AC voltage range, the switch is controlled such that the capacitance-adjusting circuit has a second capacitance value, and the first capacitance value is greater than the second capacitance value.

According to an embodiment of the present disclosure, the first AC voltage range includes 110V, and the second AC voltage range includes 220V.

According to an embodiment of the present disclosure, the range of the voltage value of the AC voltage includes 100 V-240 V, the first AC voltage range includes 100 V-120 V, and the second AC voltage range includes 220 V-240 V.

According to an embodiment of the present disclosure, the second capacitor and the switch are connected in series, and the first capacitor is connected in parallel with the series of the second capacitor and the switch.

According to an embodiment of the present disclosure, the first capacitor is connected in series with the second capacitor, and the switch is connected in parallel with the second capacitor.

According to an embodiment of the present disclosure, the device further includes a control circuit electrically connected to a control terminal of the switch.

According to an embodiment of the present disclosure, the device further includes a diode, wherein an anode of the diode is electrically connected to a first terminal of the input terminal of the rectifier circuit, and a cathode of the diode is electrically connected to the control circuit, to provide the control circuit with a value characterizing the magnitude of the AC voltage.

According to an embodiment of the present disclosure, the device further includes a first diode and a second diode; wherein an anode of the first diode is electrically connected to the first terminal of the input terminal of the rectifier circuit, an anode of the second diode is electrically connected to a second terminal of the input terminal of the rectifier circuit, and cathodes of the first and second diodes are electrically connected to the control circuit, to provide the control circuit with a value characterizing the magnitude of the AC voltage.

According to an embodiment of the present disclosure, the control circuit and the output terminal of the rectifier circuit are connected in parallel.

According to an embodiment of the present disclosure, the control circuit includes a first resistor, a second resistor, a third resistor, a Zener diode and a first MOS transistor, wherein a first terminal of the first resistor is electrically connected to a positive pole of the output terminal of the rectifier circuit, a second terminal of the first resistor is electrically connected to a first terminal of the second resistor, a second terminal of the second resistor is electrically connected to a negative pole of the output terminal of the rectifier circuit, a first terminal of the third resistor is electrically connected to the positive pole of the output terminal of the rectifier circuit, a second terminal of the third resistor is electrically connected to a drain electrode of the first MOS transistor, a source electrode of the first MOS transistor is electrically connected to the negative pole of the output terminal of the rectifier circuit, an anode of the Zener diode is electrically connected to a gate electrode of the first MOS transistor, a cathode of the Zener diode is electrically connected to the second terminal of the first resistor, and the control terminal of the switch is electrically connected to a drain electrode of the first MOS transistor.

According to an embodiment of the present disclosure, the rectifier circuit is a bridge rectifier.

According to another aspect of the present disclosure, there is provided a method for driving an LED, applied to a device for driving an LED, wherein the device for driving an LED includes: a rectifier circuit, a capacitance-adjusting circuit, a control circuit and a DC-DC converter, wherein the capacitance-adjusting circuit includes a first capacitor, a second capacitor and a switch, the first capacitor is electrically connected to the second capacitor, the switch is electrically connected to the second capacitor, the control circuit is electrically connected to a control terminal of the switch, and the method includes: converting an input AC voltage into a first DC voltage by the rectifier circuit; converting the first DC voltage into a second DC voltage by the DC-DC converter, and outputting the second DC voltage to an LED load; and controlling the switch by the control circuit, to adjust a magnitude of a capacitance value of the capacitance-adjusting circuit, wherein a range of a voltage value of the AC voltage includes a first AC voltage range and a second AC voltage range, and a voltage value in the first AC voltage range is lower than a voltage value in the second AC voltage range; when the voltage value of the AC voltage is in the first AC voltage range, the switch is controlled such that the capacitance-adjusting circuit has a first capacitance value; and when the voltage value of the AC voltage is in the second AC voltage range, the switch is controlled such that the capacitance-adjusting circuit has a second capacitance value, and the first capacitance value is greater than the second capacitance value.

According to an embodiment of the present disclosure, the first AC voltage range includes 110V, and the second AC voltage range includes 220V.

According to an embodiment of the present disclosure, the range of the voltage value of the AC voltage includes 100 V-240 V, the first AC voltage range includes 100 V-120 V. and the second AC voltage range includes 220 V-240 V.

According to an embodiment of the present disclosure, the second capacitor and the switch are connected in series, and the first capacitor is connected in parallel with the series of the second capacitor and the switch; when the voltage value of the AC voltage is in the first AC voltage range, the switch is controlled to be turned on such that the capacitance-adjusting circuit has the first capacitance value; and when the voltage value of the AC voltage is in the second AC voltage range, the switch is controlled to be turned off such that the capacitance-adjusting circuit has the second capacitance value.

According to an embodiment of the present disclosure, the first capacitor is connected in series with the second capacitor, and the switch is connected in parallel with the second capacitor; when the voltage value of the AC voltage is in the first AC voltage range, the switch is controlled to be turned on such that the capacitance-adjusting circuit has the first capacitance value; and when the voltage value of the AC voltage is in the second AC voltage range, the switch is controlled to be turned off such that the capacitance-adjusting circuit has the second capacitance value.

According to the device for driving the LED provided by the present disclosure, the capacitance value thereof may be adjusted, such that, when the input AC voltage varies greatly, it is easier for the device to meet the requirements of the CLASS C.

It is to be understood that both the foregoing general description and the following detailed description are exemplary only and are not restrictive of the disclosure.

BRIEF DESCRIPTION OF THE DRAWINGS

The above-described and other objects, features and advantages of the present disclosure will become more apparent from the detailed descriptions of exemplary embodiments with reference with the accompanying drawings.

DETAILED DESCRIPTION

Figure 1:
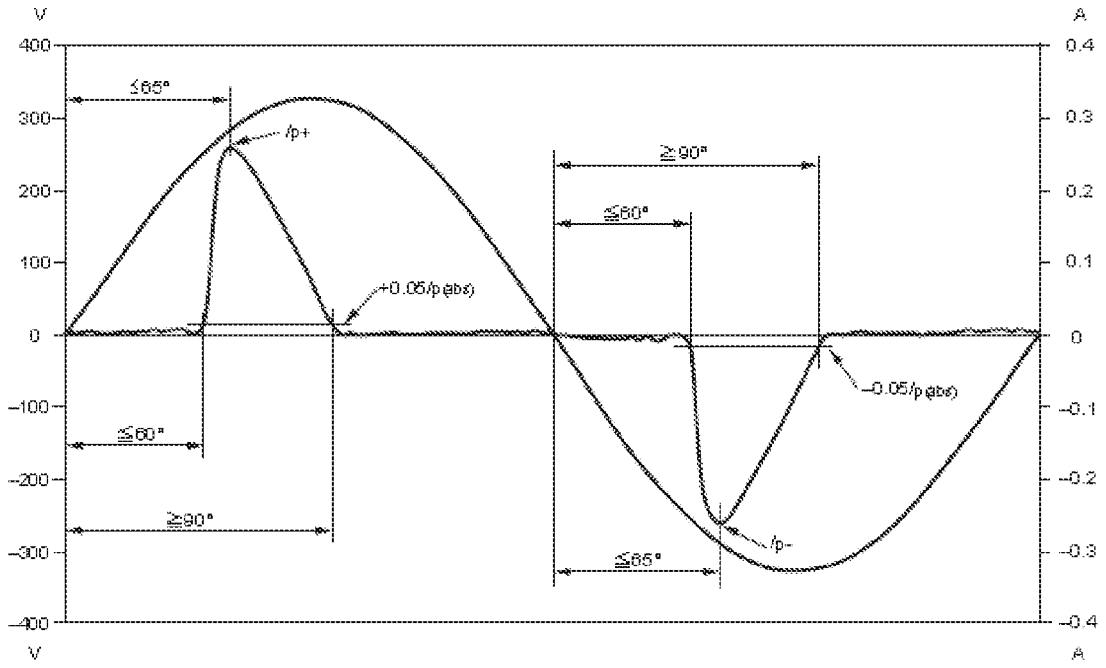
FIG. 1 is a schematic diagram of an input current waveform that meets the requirements of the CLASS C.
Figure 2:
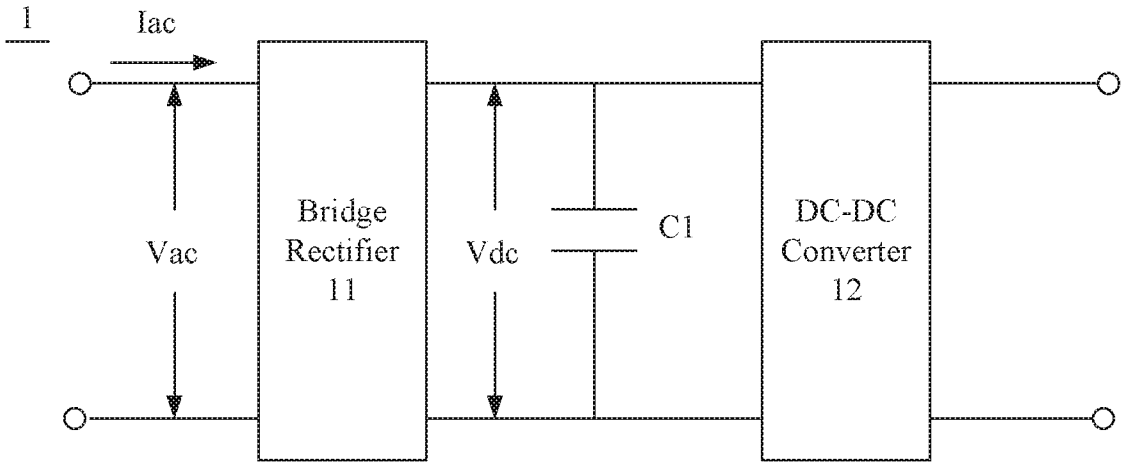
(Prior Art) FIG. 2
FIG. 2 is a schematic diagram illustrating a circuit structure applicable to an LED driving power supply device with an input power below 25 W according to an example in prior art.

Example embodiments will now be described more fully with reference to the accompanying drawings. However, the example embodiments can be embodied in a variety of forms and should not be construed as being limited to the examples set forth herein; rather, these embodiments are provided to make the present disclosure more comprehensive and complete, and fully convey the concept of the example embodiments to those skilled in the art. The drawings are only schematic representations of the disclosure and are not necessarily drawn to scale. The same reference numerals in the drawings denote the same or similar parts, and the repeated description thereof will be omitted.

In addition, the features, structures or characteristics described herein may be combined in one or more embodiments in any suitable manner. In the following description, many specific details are provided to facilitate sufficient understanding of the embodiments of the present disclosure. However, one of ordinary skill in this art will appreciate that the technical solutions in the present disclosure may be practiced without one or more of the specific details, or other methods, components, devices, or steps, and so on may be employed. In other conditions, well-known structures, methods, devices, implementations or operations are not shown or described in detail to avoid confusion of respective aspects of the present disclosure.

Moreover, terms "first" and "second" are for descriptive purpose only and are not to be construed as indicating or implying relative importance or implicitly indicating the number of technical features indicated. Thus, features defined by "first" and "second" may include one or more features either explicitly or implicitly. In the description of the present disclosure, the meaning of "a plurality of" is at least two, such as two, three, etc., unless specifically defined otherwise.

Figure 6:
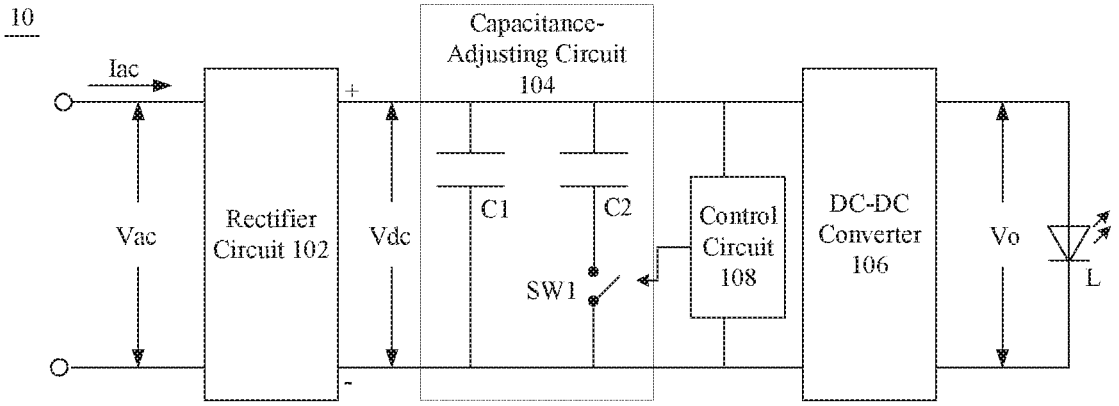
FIG. 6 is a schematic diagram illustrating a circuit structure of a device for driving an LED according to an exemplary embodiment of the disclosure.

FIG. 6 is a schematic diagram illustrating a circuit structure of a device for driving an LED according to an exemplary embodiment of the disclosure.

Referring to FIG. 6, the device for driving the LED 10 includes a rectifier circuit 102, a capacitance-adjusting circuit 104 and a DC-DC converter 106.

The rectifier circuit 102 includes an input terminal and an output terminal. The rectifier circuit 102 is configured to receive an AC voltage Vac at the input terminal and convert the AC voltage Vac into a first DC voltage Vdc at the output terminal. The input terminal of the rectifier circuit 102 receives an input current Iac.

In some embodiments, the rectifier circuit 102 may be a bridge rectifier, for example.

A voltage value range of the input AC voltage Vac includes: a first AC voltage range and a second AC voltage range. Without any loss of generality, a voltage value in the first AC voltage range is lower than a voltage value in the second AC voltage range.

In some embodiments, the first AC voltage range may include 110V for example and the second AC voltage range may include 220V for example.

In other embodiments, the voltage value range of the AC voltage Vac may include: 100V to 240V, such that the AC voltage Vac input to the device for driving the LED 10 can satisfy a wide input voltage range. In addition, the first AC voltage range may include, 100V to 120V, allowing input of AC power of 100V, 110V or 120V, for example; and the second AC voltage range may include, 220V to 240V, allowing input of AC power of 220V, 230V or 240V, for example. A voltage value in the first AC voltage range is lower than a voltage value in the second AC voltage range. In an embodiment, the first AC voltage range may include, for example, 110V and the second AC voltage range may include, for example, 220V.

The capacitance-adjusting circuit 104 is electrically connected to the output terminal of the rectifier circuit 102, and includes a capacitor C1, a capacitor C2 and a switch SW1. The capacitor C1 is electrically connected to the capacitor C2 and the switch SW1 is electrically connected to the capacitor C2.

Figure 3:
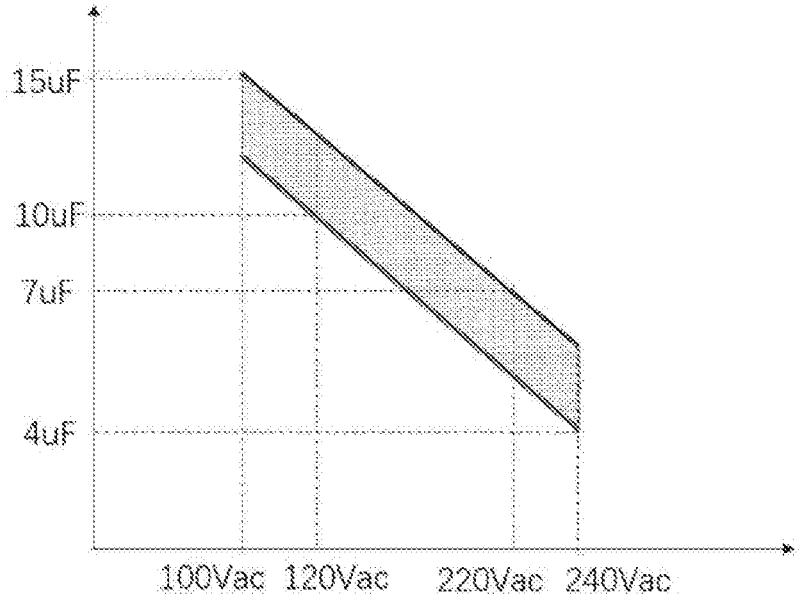
FIG. 3 is a schematic diagram illustrating relationships between an input voltage and an input capacitance of an LED driving power supply of 10 W.
Figure 4:
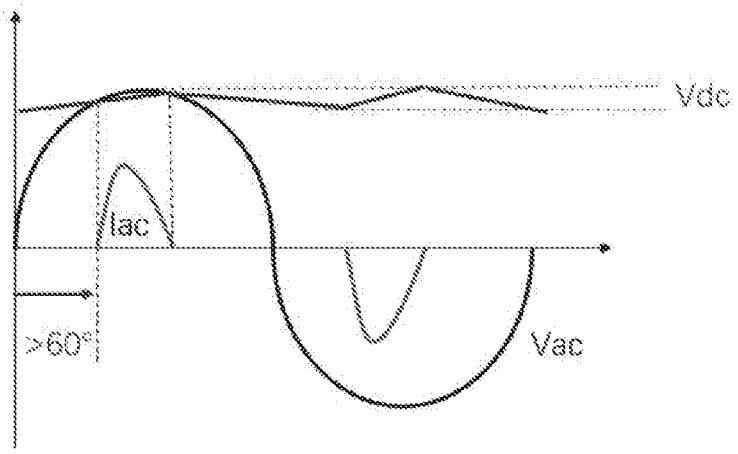
FIG. 4 is a schematic diagram of an input current waveform with large capacitor capacity.
Figure 5:
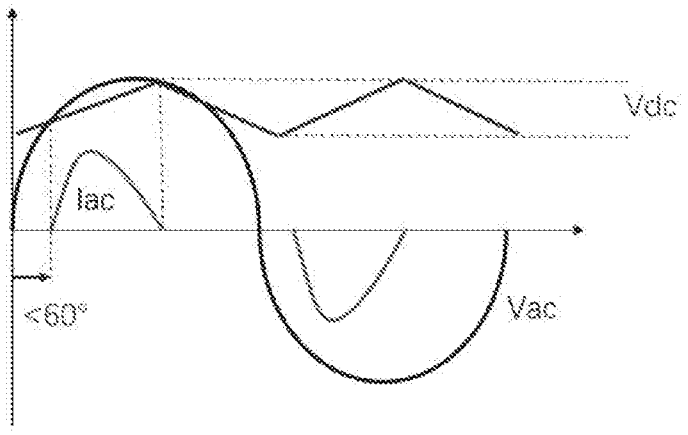
FIG. 5 is a schematic diagram of an input current waveform with small capacitor capacity.

A capacitance value of the capacitance-adjusting circuit 104 may be adjusted by controlling the switch SW1. For example, when a voltage value of the input AC voltage Vac is within the above-described first AC voltage range, the capacitance-adjusting circuit 104 may have a first capacitance value; and when the voltage value of the input AC voltage Vac is within the above-described second AC voltage range, the capacitance-adjusting circuit 104 may have a second capacitance value. Referring to FIG. 3, the first capacitance value applied to the first AC voltage rang is greater than the second capacitance value applied to the second AC voltage range Specifically, for example, as illustrated in FIG. 6, the capacitor C2 is connected to the switch SW1 in series and the series branch formed by connecting the capacitor C2 and the switch SW1 is connected to the capacitor C1 in parallel. When the voltage value of the input AC voltage Vac is within the first AC voltage range described above, the switch SW1 is controlled to be turned on and the capacitor C1 and the capacitor C2 are connected in parallel, at this time, the first capacitance value is equal to a capacitance value of the capacitor C1 and the capacitor C2 connected in parallel; and when the voltage value of the input AC voltage Vac is within the above-mentioned second AC voltage range, the switch SW1 is controlled to be turned off, the capacitor C2 is disconnected, and only the capacitor C1 is used, then the second capacitance value is equal to a capacitance value of the capacitor C1. Therefore, the first capacitance value is greater than the second capacitance value.

As described above, the capacitance value of the capacitance-adjusting circuit 104 may be adjusted by controlling the switch SW1, thus the capacitance-adjusting circuit 104 will have different capacitance values when the voltage value of the input AC voltage Vac is within different AC voltage ranges. In particular, when the device for driving the LED 10 is used in the case of an input power below 25 W, the requirements of CLASS C will be met more easily.

For example, the input power is 10 W, the first AC voltage range is from 100V to 120V and the second AC voltage range is from 220V to 240V. Referring to FIG. 3, when the input AC voltage Vac falls into the first AC voltage range, the first capacitance value of the capacitance-adjusting circuit 104 may be adjusted to range between 10 uF to 15 uF; and when the input AC voltage Vac falls into the second AC voltage range, the second capacitance value of the capacitance-adjusting circuit 104 may be adjusted to range between 4 uF to 7 uF.

The DC-DC converter 106 is electrically connected to the capacitance-adjusting circuit 104, and is configured to convert the first DC voltage Vdc into a second DC voltage Vo to drive an LED load L.

In particular, according to the device for driving the LED provided by an embodiment of the present disclosure, the capacitance value thereof may be adjusted, such that when the voltage value of the input AC voltage is in different AC voltage ranges, it is easier for the device for driving the LED to meet the requirements of the CLASS C.

Figure 7:
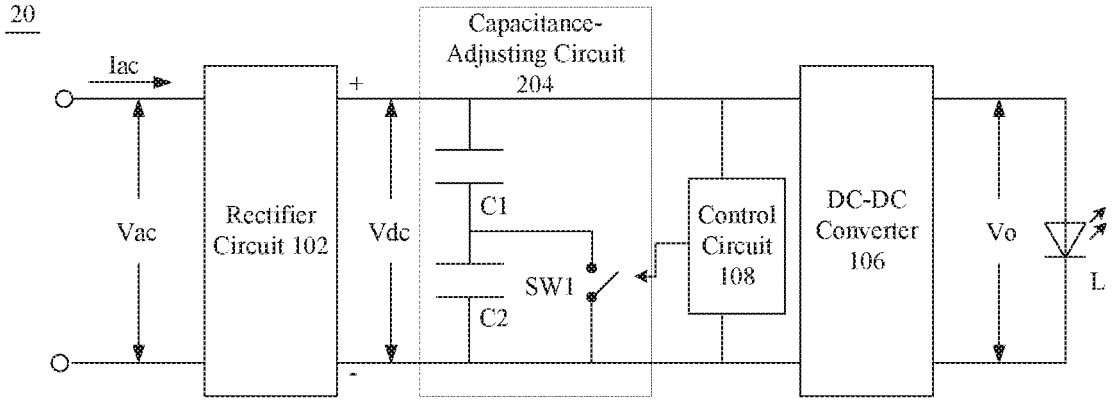
FIG. 7 is a schematic diagram illustrating a circuit structure of a device for driving an LED according to an exemplary embodiment of the disclosure.

FIG. 7 is a schematic diagram illustrating a circuit structure of a LED driving device according to an exemplary embodiment of the disclosure. The device for driving the LED 20 illustrated in FIG. 7 differs from the device for driving the LED 10 illustrated in FIG. 6 in that the capacitor C1 is connected to the capacitor C2 in series and the switch SW1 is connected to the capacitor C2 in series in its capacitance-adjusting circuit 204. When the voltage value of the input AC voltage Vac is within the above-mentioned first AC voltage range, the switch SW1 is controlled to be turned on, the capacitor C2 is short-circuited, and only the capacitor C1 is used, at this time, the first capacitance value is equal to the capacitance value of the capacitor C1; and when the voltage value of the input AC voltage Vac is within the above-mentioned second AC voltage range, the switch SW1 is controlled to be turned off, the capacitor C1 and the capacitor C2 are connected in series, at this time, the second capacitance value is equal to a capacitance value of the capacitor C1 and the capacitor C2 connected in series. Therefore, the first capacitance value is greater than the second capacitance value. In another example, the switch SW1 may be connected to the capacitor C1 in parallel, that is, positions of the capacitor C1 and the capacitor C2 are exchanged.

The same parts of the device for driving the LED 20 illustrated in FIG. 7 as those of the device for driving the LED 10 illustrated in FIG. 6 will not be elaborated herein.

Referring to FIG. 6 or FIG. 7, the device for driving the LED 10 or the device for driving the LED 20 further includes a control circuit 108. The control circuit 108 is electrically connected to a control terminal of the switch SW1 for controlling the switch SW1, thereby adjusting the capacitance value of the capacitance-adjusting circuit 104 or the capacitance-adjusting circuit 204.

Figure 8:
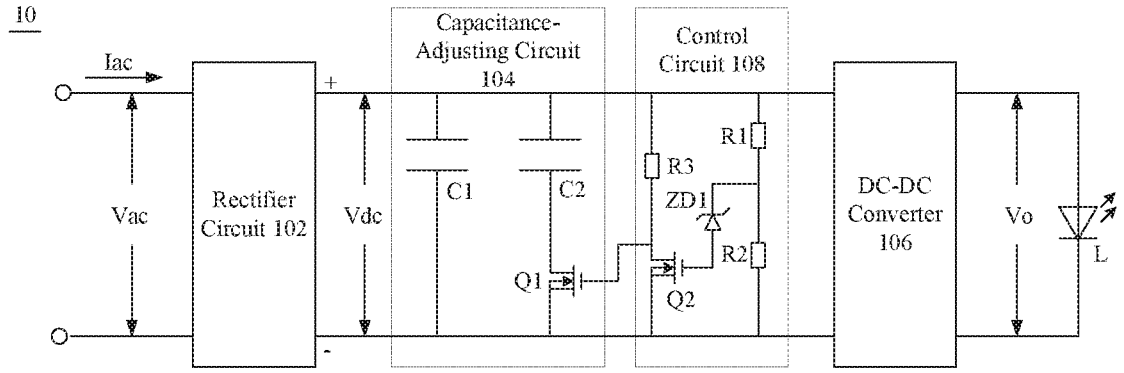
FIG. 8 is a schematic diagram illustrating a circuit structure of a device for driving an LED according to an exemplary embodiment of the disclosure.

FIG. 8 is a schematic diagram illustrating a circuit structure of a device for driving an LED according to an exemplary embodiment of the disclosure. Without loss of generality, in FIG. 8, explanations will be made to a circuit structure of the control circuit 108 and the principle of controlling the switch SW1, by an example that the capacitor C2 is connected to the switch SW1 in series and the formed series branch is connected to the capacitor C1 in parallel.

Referring to FIG. 8, the control circuit 108 includes a resistor R1, a resistor R2, a resistor R3, a Zener diode ZD1 and a Metal Oxide Semiconductor (MOS) transistor Q2. A first terminal of the resistor R1 is electrically connected to a positive pole of the output terminal of the rectifier circuit 102, a second terminal of the resistor R1 is electrically connected to a first terminal of the resistor R2, and a second terminal of the resistor R2 is electrically connected to a negative pole of the output terminal of the rectifier circuit 102. A first terminal of the resistor R3 is electrically connected to the positive pole of the output terminal of the rectifier circuit, and a second terminal of the resistor R3 is electrically connected to a drain electrode of the MOS transistor Q2. A source electrode of the MOS transistor Q2 is electrically connected to the negative pole of the output terminal of the rectifier circuit 102. An anode of the Zener diode ZD1 is electrically connected to a gate electrode of the MOS transistor Q2, and a cathode of the Zener diode is electrically connected to the second terminal of the resistor R1. The switch SW1 (taking a MOS transistor Q1 as an example) has a control terminal (i.e., a gate electrode of the MOS transistor Q1) which is electrically connected to the drain electrode of the MOS transistor Q2.

When a voltage value of input AC voltage Vac is within the above-mentioned first AC voltage range which is relatively lower, the input voltage of the capacitor C is divided by the resistor R1 and the resistor R2, a voltage at the cathode of Zener diode ZD1 is lower than a breakdown voltage of the Zener diode ZD1, thus the MOS transistor Q2 is turned off, the switch SW1 (MOS transistor Q1) is turned on by the voltage supplied from the resistor R3, and thus the capacitor C1 and the capacitor C2 are connected in parallel, at this time, the first capacitance value is a capacitance value of the capacitor C1 and the capacitor C2 connected in parallel. When the voltage value of the input AC voltage Vac is within the above-mentioned second AC voltage range which is relatively higher, the input voltage of the capacitor C1 is divided by the resistor R1 and the resistor R2, the voltage at the cathode of Zener diode ZD1 is greater than the breakdown voltage of the Zener diode ZD1, thus the MOS transistor Q2 is turned on, the switch SW1 (MOS transistor Q1) is turned off, the capacitor C2 is disconnected, and only the capacitor C1 is left in use, at this time, the second capacitance value is equal to the capacitance value of the capacitor C1. Therefore, the first capacitance value is greater than the second capacitance value.

Figure 9:
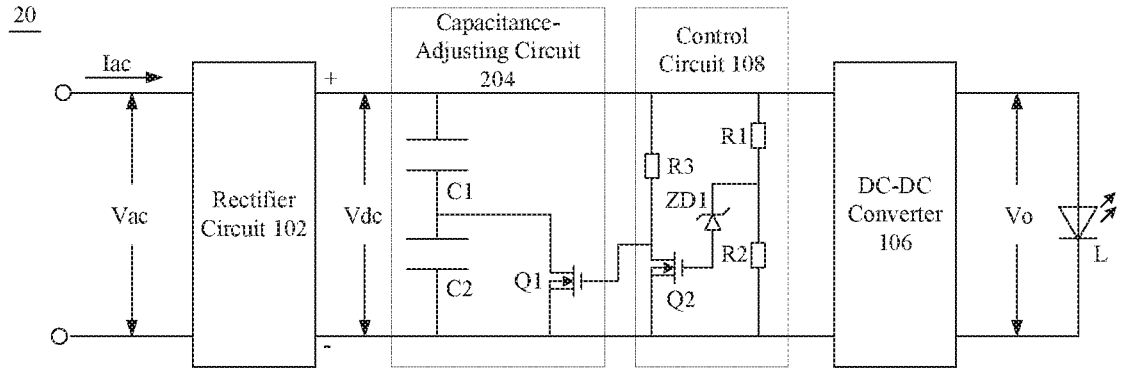
FIG. 9 is a schematic diagram illustrating a circuit structure of a device for driving an LED according to an exemplary embodiment of the disclosure.

Likewise, the control circuit 108 illustrated in FIG. 8 is equally applicable to the device for driving the LED 20 illustrated in FIG. 7. FIG. 9 is a schematic diagram further illustrating the application of the control circuit 108 to the circuit structure of the device for driving the LED 20 illustrated in FIG. 7. As illustrated in FIG. 9, when the voltage value of the input AC voltage Vac is within the above-mentioned first AC voltage range, the output voltage Vdc of the rectifier circuit 102 is divided by the resistor R1 and the resistor R2, the voltage at the cathode of Zener diode ZD1 is lower than the breakdown voltage of the Zener diode ZD1, thus the MOS transistor Q2 is turned off, the switch SW1 (MOS transistor Q1) is turned on by the voltage supplied from the resistor R3, the capacitor C2 is short-circuited to leave only the capacitor C1 in use, at this time, the first capacitance value is equal to the capacitance value of the capacitor C1. When the voltage value of the input AC voltage Vac is within the above-mentioned second AC voltage range, the output voltage Vdc of the rectifier circuit 102 is divided by the resistor R1 and the resistor R2, the voltage at the cathode of Zener diode ZD1 is greater than the breakdown voltage of the Zener diode ZD1, thus the MOS transistor Q2 is turned on, the switch SW1 (MOS transistor Q1) is turned off and the capacitor C1 and the capacitor C2 are connected in series, at this time, the second capacitance value is equal to a capacitance value of the capacitor C1 and the capacitor C2 connected in series. Therefore, the first capacitance value is greater than the second capacitance value.

It should be noted that those skilled in the art can understand that explanations is made in an example that the switch in FIG. 8 and FIG. 9 is an N-type MOS transistor, but other switches having the same function are applicable to the control circuit 108 of the present disclosure.

Referring to FIG. 6 or FIG. 7, the control circuit 108 is connected in parallel with the output terminal of the rectifier circuit 102 to detect a magnitude of the output voltage Vdc of the rectifier circuit 102 to obtain a value characterizing the magnitude of the AC voltage Vac. The turn-on and turn-off of the switch SW1 are controlled according to the magnitude of the output voltage Vdc, so as to adjust the capacitance value of the capacitance-adjusting circuit 104 or the capacitance-adjusting circuit 204.

Figure 10:
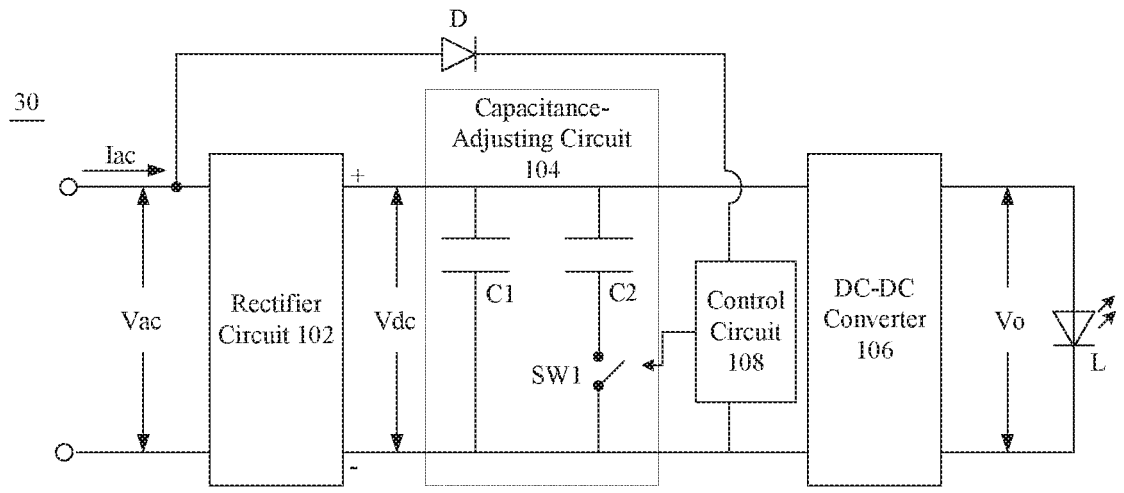
FIG. 10 is a schematic diagram illustrating a circuit structure of a device for driving an LED according to an exemplary embodiment of the disclosure.
Figure 11:
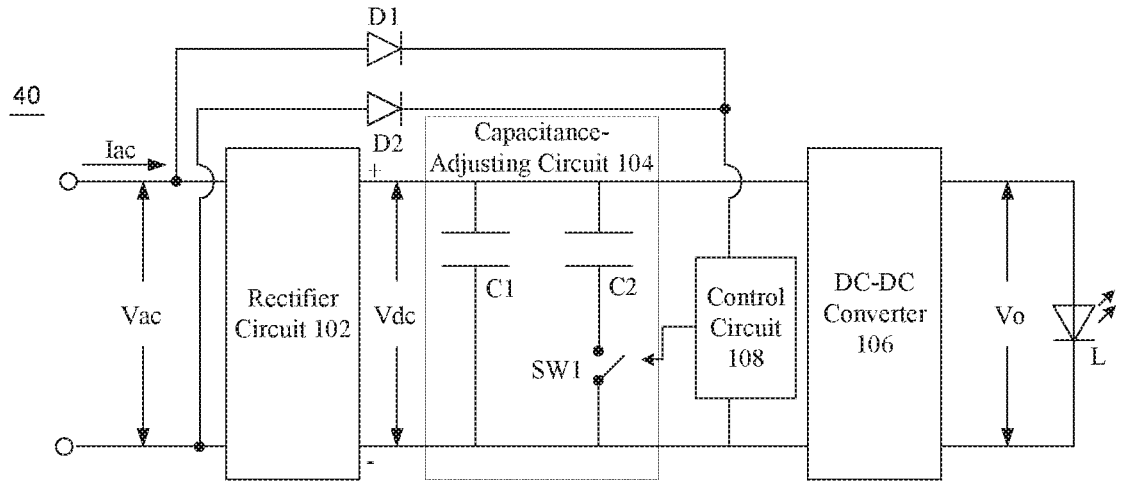
FIG. 11 is a schematic diagram illustrating a circuit structure of a device for driving an LED according to an exemplary embodiment of the disclosure.

In addition, FIGS. 10 and 11 illustrate other two connection manners of the control circuit 108 respectively. Still taking the capacitance-adjusting circuit 104 illustrated in FIG. 6 as an example, referring to FIG. 10, an LED driving device 30 further includes a diode D. An anode of the diode D is electrically connected to a first terminal of the input terminal of the rectifier circuit 102, and a cathode of the diode D is electrically connected to the control circuit 108, so as to provide the control circuit 108 with a value characterizing the magnitude of the AC voltage Vac based on the voltage rectified by the diode D. Thereby, the turn-on and turn-off of the switch SW1 are controlled according to the AC voltage Vac input to the rectifier circuit 102, so as to adjust the capacitance value of the capacitance-adjusting circuit 104 or the capacitance-adjusting circuit 204. At this time, the control circuit 108 and the output terminal of the rectifier circuit 102 are no longer connected in parallel. The capacitance-adjusting circuit 104 in the embodiment can be replaced by the capacitance-adjusting circuit 204 in FIG. 7, which will not be elaborated again.

Referring to FIG. 11, an LED driving device 40 includes a diode D1 and a diode D2. An anode of the diode D1 is electrically connected to the first terminal of the input terminal of the rectifier circuit, an anode of the diode D2 is electrically connected to a second terminal of the input terminal of the rectifier circuit, and cathodes of the diodes D1 and D2 are electrically connected to the control circuit 108, so as to provide the control circuit 108 with a value characterizing the magnitude of the AC voltage Vac input to the rectifier circuit 102, wherein the value enables the control circuit 108 to control the turn-on and turn-off of the switch SW1 according to the characterized voltage rectified by the diodes D1 and D2.switch, so as to adjust the capacitance value of the capacitance-adjusting circuit 104 or the capacitance-adjusting circuit 204. At this time, the control circuit 108 and the output terminal of the rectifier circuit 102 are no longer connected in parallel. The capacitance-adjusting circuit 104 in the embodiment can be replaced by the capacitance-adjusting circuit 204 in FIG. 7, which will not be elaborated again.

A method embodiment of the present disclosure will be described below which is applicable to the above-described device embodiments of the present disclosure. For details not disclosed in the method embodiment of the present disclosure, please refer to the device embodiments thereof.

Figure 12:
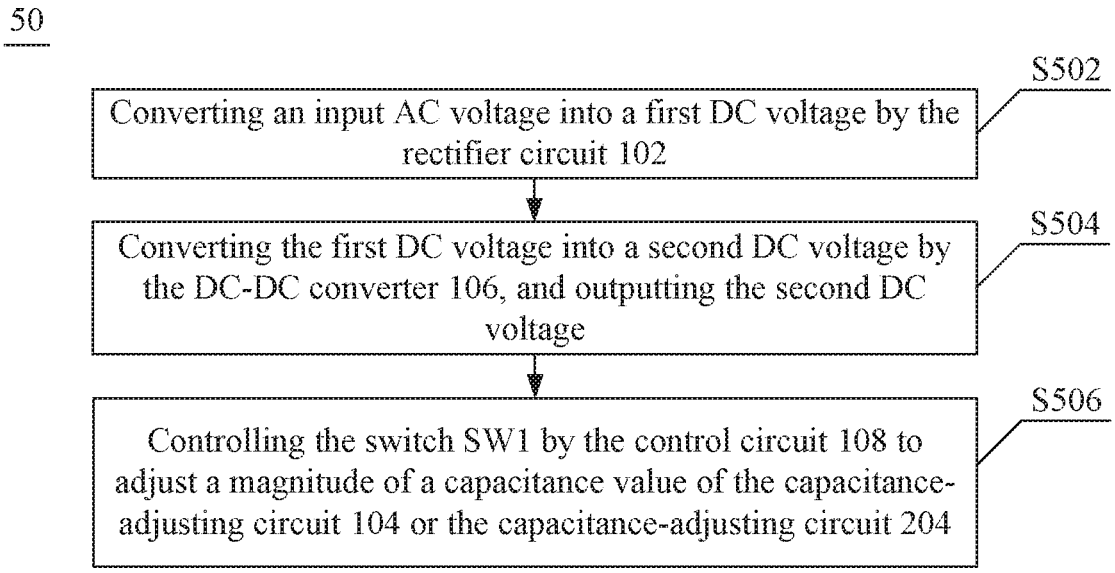
FIG. 12 is a flowchart illustrating a method for driving an LED according to an exemplary embodiment of the disclosure.

FIG. 12 is a flowchart illustrating a method for driving an LED according to an exemplary embodiment of the disclosure. The method for driving the LED is applicable to any of the above-described LED driving devices.

Taking the device for driving the LED 10 or the device for driving the LED 20 illustrated in FIG. 6 or FIG. 7 as an example, referring to FIG. 6 or FIG. 7 with FIG. 12, the method 50 of the disclosure includes the following steps.

In step S502, the input AC voltage is converted into the first DC voltage by the rectifier circuit 102.

In step S504, the first DC voltage is converted into the second DC voltage by the DC-DC converter 106, and the second DC voltage is output.

In step S506, the switch SW1 is controlled by the control circuit 108 to adjust the magnitude of the capacitance value of the capacitance-adjusting circuit 104 or the capacitance-adjusting circuit 204.

A range of the voltage value of the AC voltage includes a first AC voltage range and a second AC voltage range, wherein a voltage value in the first AC voltage range is lower than a voltage value in the second AC voltage range, and when the voltage value of the AC voltage is in the first AC voltage range, the switch SW1 is controlled such that the capacitance-adjusting circuit 104 or the capacitance-adjusting circuit 204 has the first capacitance value; and when the voltage value of the AC voltage is in the second AC voltage range, the switch SW1 is controlled such that the capacitance-adjusting circuit 104 or the capacitance-adjusting circuit 204 has the second capacitance value, wherein the first capacitance value is greater than the second capacitance value.

In some embodiments, the first AC voltage range includes 110V and the second AC voltage range includes 220V.

In some embodiments, the range of the voltage value of the AC voltage includes 100 V-240 V, the first AC voltage range includes 100 V-120 V, and the second AC voltage range includes 220 V-240 V.

In some embodiments, referring to FIG. 6, the capacitor C2 and the switch SW1 are connected in series, and the capacitor C1 is connected in parallel with the series branch of the capacitor C2 and the switch SW1. When the voltage value of the AC voltage is in the first AC voltage range, the switch SW1 is controlled to be turned on such that the capacitance-adjusting circuit 104 has the first capacitance value; and when the voltage value of the AC voltage is in the second AC voltage range, the switch SW1 is controlled to be turned off such that the capacitance-adjusting circuit 104 has the second capacitance value.

In some embodiments, referring to FIG. 7, the capacitor C1 and the capacitor C2 are connected in series, and the switch SW1 and the capacitor C2 are connected in parallel. When the voltage value of the AC voltage is in the first AC voltage range, the switch SW1 is controlled to be turned on such that the capacitance-adjusting circuit 204 has the first capacitance value; and when the voltage value of the AC voltage is in the second AC voltage range, the switch SW1 is controlled to be turned off such that the capacitance-adjusting circuit 204 has the second capacitance value.

It is to be noted that the above-described drawings are merely illustrative of the processes included in the method according to the exemplary embodiment of the present disclosure, and are not intended to be limiting. It is to be easily understood that the processes illustrated in the above drawings do not indicate or limit a chronological order of the processes. In addition, it is also easy to understand that the processes may be performed synchronously or asynchronously in a plurality of modules, for example.

The exemplary embodiments of the present disclosure have been illustrated and described in detail as above. It should be understood that, the present disclosure is not limited to the detailed structure, the configuration and implementation described herein. Instead, the present disclosure intends to cover various modifications and equivalents falling within the spirit and scope of the appended claims.

What is claimed is:

1. A device for driving an LED, comprising:

a rectifier circuit, having an input terminal and an output terminal, and configured to receive an AC voltage at the input terminal and convert the AC voltage into a first DC voltage at the output terminal;

a capacitance-adjusting circuit, electrically connected to the output terminal of the rectifier circuit, and comprising a first capacitor, a second capacitor and a switch, wherein the first capacitor is electrically connected to the second capacitor and the switch is electrically connected to the second capacitor; and a DC-DC converter, electrically connected to the capacitance-adjusting circuit, and configured to convert the first DC voltage into a second DC voltage to drive an LED load, wherein a range of the AC voltage comprises a first AC voltage range and a second AC voltage range, and a voltage value in the first AC voltage range is lower than a voltage value in the second AC voltage range, when the voltage value of the AC voltage is in the first AC voltage range, the switch is controlled such that the capacitance-adjusting circuit has a first capacitance value; and when the voltage value of the AC voltage is in the second AC voltage range, the switch is controlled such that the capacitance-adjusting circuit has a second capacitance value, and the first capacitance value is greater than the second capacitance value, the device for driving the LED further comprises a control circuit electrically connected to a control terminal of the switch, the control circuit and the output terminal of the rectifier circuit are connected in parallel, and the control circuit comprises a first resistor, a second resistor, a third resistor, a Zener diode and a first MOS transistor, wherein a first terminal of the first resistor is electrically connected to a positive pole of the output terminal of the rectifier circuit, a second terminal of the first resistor is electrically connected to a first terminal of the second resistor, a second terminal of the second resistor is electrically connected to a negative pole of the output terminal of the rectifier circuit, a first terminal of the third resistor is electrically connected to the positive pole of the output terminal of the rectifier circuit, a second terminal of the third resistor is electrically connected to a drain electrode of the first MOS transistor, a source electrode of the first MOS transistor is electrically connected to the negative pole of the output terminal of the rectifier circuit, an anode of the Zener diode is electrically connected to a gate electrode of the first MOS transistor, a cathode of the Zener diode is electrically connected to the second terminal of the first resistor, and the control terminal of the switch is electrically connected to a drain electrode of the first MOS transistor.

2. The device for driving the LED according to claim 1, wherein the first AC voltage range comprises 110V, and the second AC voltage range comprises 220V.

3. The device for driving the LED according to claim 2, wherein the range of the voltage value of the AC voltage comprises 100 V-240 V, the first AC voltage range comprises 100 V-120 V, and the second AC voltage range comprises 220 V-240 V.

4. The device for driving the LED according to claim 1, wherein the second capacitor and the switch are connected in series, and the first capacitor is connected in parallel with the series of the second capacitor and the switch.

5. The device for driving the LED according to claim 1, wherein the first capacitor is connected in series with the second capacitor, and the switch is connected in parallel with the second capacitor.

6. The device for driving the LED according to claim 1, wherein the rectifier circuit is a bridge rectifier.

7. A method for driving an LED, applied to a device for driving an LED, wherein the device for driving an LED comprises: a rectifier circuit, a capacitance-adjusting circuit, a control circuit and a DC-DC converter, wherein the capacitance-adjusting circuit comprises a first capacitor, a second capacitor and a switch, the first capacitor is electrically connected to the second capacitor, the switch is electrically connected to the second capacitor, the control circuit is electrically connected to a control terminal of the switch, the control circuit and the output terminal of the rectifier circuit are connected in parallel, the control circuit comprises a first resistor, a second resistor, a third resistor, a Zener diode and a first MOS transistor, wherein a first terminal of the first resistor is electrically connected to a positive pole of the output terminal of the rectifier circuit, a second terminal of the first resistor is electrically connected to a first terminal of the second resistor, a second terminal of the second resistor is electrically connected to a negative pole of the output terminal of the rectifier circuit, a first terminal of the third resistor is electrically connected to the positive pole of the output terminal of the rectifier circuit, a second terminal of the third resistor is electrically connected to a drain electrode of the first MOS transistor, a source electrode of the first MOS transistor is electrically connected to the negative pole of the output terminal of the rectifier circuit, an anode of the Zener diode is electrically connected to a gate electrode of the first MOS transistor, a cathode of the Zener diode is electrically connected to the second terminal of the first resistor, and the control terminal of the switch is electrically connected to a drain electrode of the first MOS transistor, and the method comprises:

converting an input AC voltage into a first DC voltage by the rectifier circuit;

converting the first DC voltage into a second DC voltage by the DC-DC converter, and outputting the second DC voltage to an LED load; and controlling the switch by the control circuit, to adjust a magnitude of a capacitance value of the capacitance-adjusting circuit, wherein a range of a voltage value of the AC voltage comprises a first AC voltage range and a second AC voltage range, and the first AC voltage range is lower than the second AC voltage range; when the voltage value of the AC voltage is in the first AC voltage range, the switch is controlled such that the capacitance-adjusting circuit has a first capacitance value; and when the voltage value of the AC voltage is in the second AC voltage range, the switch is controlled such that the capacitance-adjusting circuit has a second capacitance value, and the first capacitance value is greater than the second capacitance value.

8. The method according to claim 7, wherein the first AC voltage range comprises 110V, and the second AC voltage range comprises 220V.

9. The method according to claim 8, wherein the range of the voltage value of the AC voltage comprises 100 V-240 V, the first AC voltage range comprises 100 V-120 V, and the second AC voltage range comprises 220 V-240 V.

10. The method according to claim 7, wherein the second capacitor and the switch are connected in series, and the first capacitor is connected in parallel with the series of the second capacitor and the switch; when the voltage value of the AC voltage is in the first AC voltage range, the switch is controlled to be turned on such that the capacitance-adjusting circuit has the first capacitance value; and when the voltage value of the AC voltage is in the second AC voltage range, the switch is controlled to be turned off such that the capacitance-adjusting circuit has the second capacitance value.

11. The method according to claim 7, wherein the first capacitor is connected in series with the second capacitor, and the switch is connected in parallel with the second capacitor; when the voltage value of the AC voltage is in the first AC voltage range, the switch is controlled to be turned on such that the capacitance-adjusting circuit has the first capacitance value; and when the voltage value of the AC voltage is in the second AC voltage range, the switch is controlled to be turned off such that the capacitance-adjusting circuit has the second capacitance value.

* * * * *